US006810621B1

(12) United States Patent
Ricci

(10) Patent No.: US 6,810,621 B1
(45) Date of Patent: Nov. 2, 2004

(54) FRICTION BRAKE FOR LOUVERED STRUCTURES

(75) Inventor: Fernando Ricci, Montréal (CA)

(73) Assignee: Ricci Tools Inc., Montreal (CA)

( * ) Notice: Subject to any disclaimer, the term of this patent is extended or adjusted under 35 U.S.C. 154(b) by 0 days.

(21) Appl. No.: 10/454,473

(22) Filed: Jun. 5, 2003

(51) Int. Cl.[7] ..... E06B 7/086
(52) U.S. Cl. ..... 49/90.1; 49/403
(58) Field of Search ..... 49/74.1, 87.1, 49/90.1, 403

(56) References Cited

U.S. PATENT DOCUMENTS 4,294,283 A * 10/1981 Scharres ..... 137/599.02
6,536,162 B2 * 3/2003 LaMay ..... 49/403
2003/0136053 A1 * 7/2003 Norbert ..... 49/74.1

* cited by examiner

*Primary Examiner*—Jerry Redman
(74) *Attorney, Agent, or Firm*—Ogilvy Renault; Guy J. Houle

(57) ABSTRACT

A friction brake for a louvered structure having a plurality of slats pivotally interconnected between opposed stiles of a rectangular frame is described. The friction brake is a flat arm having a pair of spaced apertures. One of the apertures is dimensioned to receive a cylindrical sleeve of a connector which is secured to a pivot rod of a slat and the other aperture is dimensioned for friction fit about the cylindrical sleeve connected to the pivot rod of an adjacent slat whereby to arrest the connector and all the slats. All of the slats are interconnected together by a longitudinal slat interconnecting member which is pivotally connected to all of the slat connectors whereby when any slat is positioned to a desired slat angle all of the other slats will move in unison to that desired angle and be retained thereat by the friction retention of the second aperture of the friction brake about the cylindrical sleeve of one of the slats. Two or more friction brakes can be mounted in a stile.

10 Claims, 3 Drawing Sheets

FRICTION BRAKE FOR LOUVERED STRUCTURES

FRICTION BRAKE FOR LOUVERED STRUCTURES FIELD OF THE INVENTION

The present invention relates to a friction brake for a louvered structure having a plurality of slats pivotally interconnected between opposed stiles of a rectangular frame and wherein one or more of these friction brakes can be secured to the interconnected pivoting assembly of the louvers in one of the stiles.

BACKGROUND OF THE INVENTION

Louvered structures including movable louvers all hingeable in unison is well known in the art. These louvers are usually opened and closed by a control bar which is attached to the horizontal edge of the louvers or by a control mechanism which is accessible on the louve stile as is described in my U.S. Pat. No. 6,145,251. By moving the control bar or a control knob in an up and down direction, the louvers are opened or closed or arrested at an intermediate position. These control bars are unsightly and add weight to a side edge of the louvers creating an imbalance and for this reason louver structures have departed from the use of such control bars.

Another method of retaining louvers at a desired angular position is to provide strong frictional resistance between the louver ends and the support frame. This is done by effectively clamping the frame tightly against the outside edges of the louvers. In certain louver constructions, and in particular, in vinyl constructions, it is neither desirable nor feasible to provide sufficient frictional resistance between the louver and the frame to hold the louvers at a set angular position.

U.S. Pat. No. 5,191,735 teaches the use of a movable louver clamp which is constituted by an elongated vinyl pivot clamp extending the full length of the styles in a cavity region thereof and adjacent the holes which receive the pivot pins of the louvers. Accordingly, this pivot pin clamp applies a clamping force against each of the pins and again these louvers are interconnected and displaced to a desired angle by the use of a control bar. Because the louver pivot pin are made of plastic material they will become more slippery with wear and tear and eventually the clamp has no longer an effect on some or all of these louvers thereby defeating this clamping system. If one of the louvers becomes loose about their pivot pin it is necessary to disassemble the entire louver structure to remove the longitudinal pivot pin clamp and this is costly and time-consuming. This solution has not proved to be satisfactory.

SUMMARY OF THE INVENTION

It is a feature of the present invention to provide a friction brake which substantially overcomes the abovementioned disadvantages of the prior art.

Another feature of the present invention is to provide a friction brake which is simple, economical, easy to install and wherein one or more of these brakes can be installed in one or both vertical stiles of a louvered structure frame.

Another feature of the present invention is to provide a friction brake which permits the louvers to be positioned at any desired angle without the use of a control bar and/or any positioning mechanism whereby the displacement of a single louver by the use of the fingers is sufficient to set a desired louver angle for all of the louvers that are interconnected together within one of the stiles.

According to the above features, from a broad aspect, the present invention provides a louvered structure having a plurality of slats pivotally interconnected between opposed styles of a rectangular frame. Each of the slats has a pivot rod projecting from opposed end walls thereof and extending into axially aligned holes formed in an inner face of the opposed stiles. A connector is secured to each of the pivot rods in one of the styles. The connector has a cylindrical sleeve secured about the pivot rod and at least one connector arm extends laterally from the cylindrical sleeve. The connector arm of the connector of each of the slats is interconnected to a longitudinal slat interconnecting member by a pivot connection secured to each connector arm whereby all of the slats pivot in unison about the pivot rods. A friction brake member is also provided and has a first and a second spaced apart aperture. The first aperture is dimensioned to receive a cylindrical sleeve of one of the connectors in close rotational fit therein. The second aperture is dimensioned for friction fit about a cylindrical sleeve of an adjacent connector to arrest the adjacent connector and its associated slat, and all other connectors and associated slats interconnected thereto by the longitudinal slat interconnecting member, at a desired slat angle by displacing any one of the slats to the said desired angle.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 1:
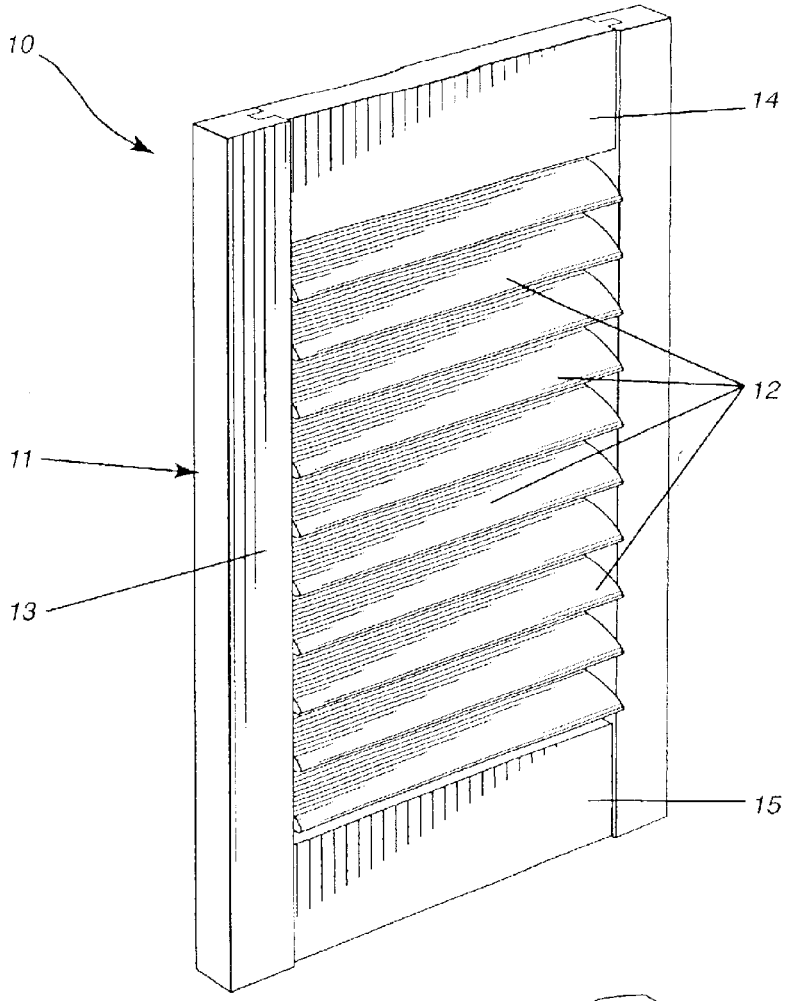
FIG. 1 is a perspective view of a louvered structure having a plurality of slats pivotally interconnected between opposed stiles of a rectangular frame.

Referring now to the drawings and more particularly to FIG. 1 there is shown generally at 10 a louvered structure comprising a frame 11 having a pair of vertical stiles 13 and a top and bottom header 14 and 15 respectively. A plurality of slats 12 are pivotally secured between the vertical stiles 13.

Figure 2:
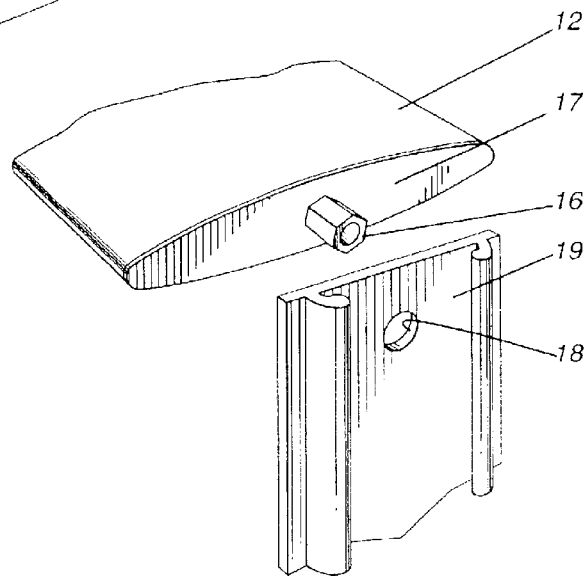
FIG. 2 is a fragmented perspective view showing the pivot rod which projects from opposed end walls of a slat and its location within a hole of an inner wall of a stile.

As shown in FIG. 2 each of the slats 12 has a pivot rod 16 projecting from opposed end walls 17 thereof and extending into axially aligned holes 18 herein only one being shown formed in the style inner walls 19.

Figure 3:
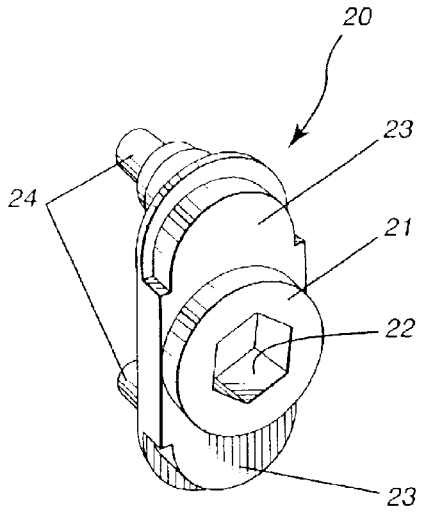
FIG. 3 is a perspective view showing the construction of the connector which is secured to the pivot rod of the slats.
Figure 6:
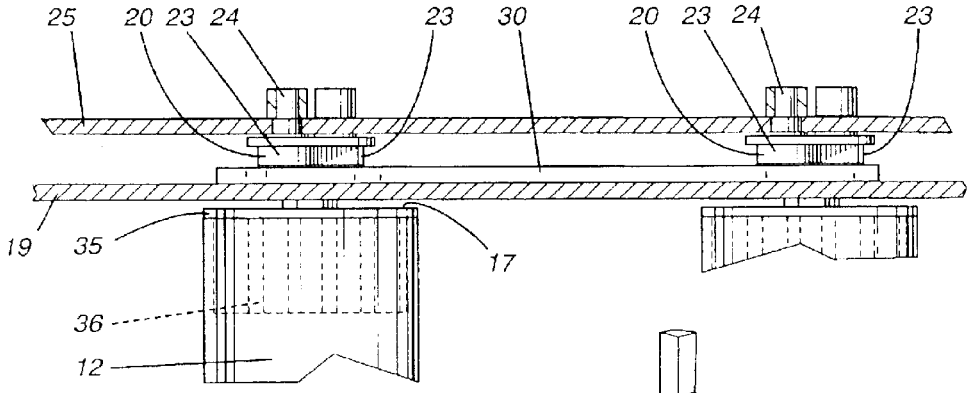
FIG. 6 is a fragmented and partly sectioned end view of a slat interconnected within a vertical style and showing the position of the friction brake member in relation to other members.
Figure 9:
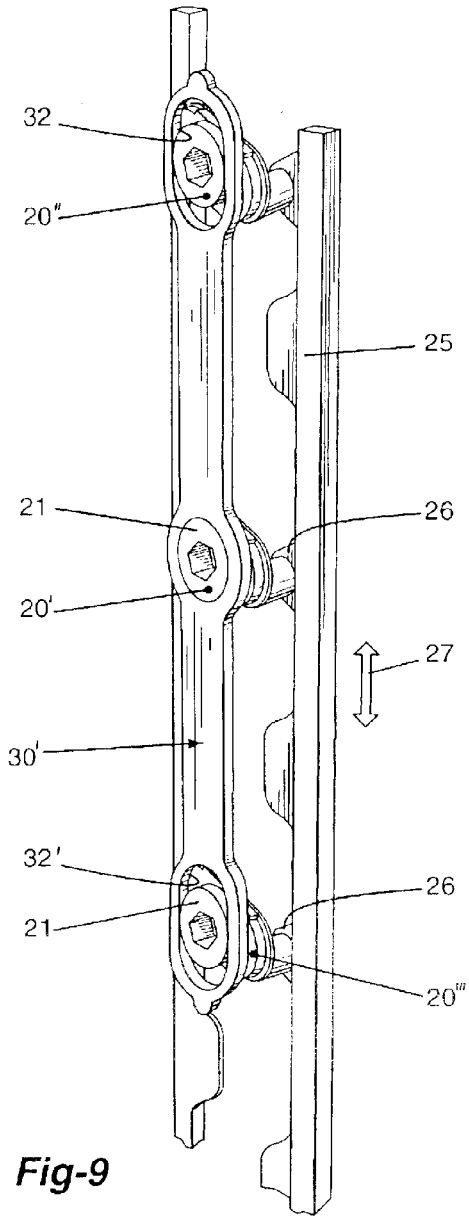
FIG. 9 is a perspective view showing the position of the friction brake member as viewed from the inner side of the style facing the stile inner wall.

As shown in FIGS. 3, 6 and 9 a connector 20 is secured to each of the pivot rods 16 in one of the stiles 12. The connector has a cylindrical sleeve 21 provided with a through bore 22 which has a cross section to match and receive the pivot rod 16 in close fit therein. This cross section is non-circular and as hereinshown is hexagonal. Accordingly, the connector 20 can be positively secured to the pivot rod which extends within the verticals stile 13. The connector has at least one connector arm 23, however herein being shown as provided with two connecting arms, and a pivot pin 24 projects upwardly from the connector arms on the side thereof opposed from the cylindrical sleeve 21. The cylindrical sleeve, the connector arms 23 and the pins 24 are all integrally formed from plastic material as a single part. The arm also extends diametrically from the cylindrical sleeve 21 on opposed sides thereof. It is pointed out that this connector and its connection to the slats is described in my U.S. Pat. No. 6,145,251.

Figure 4:
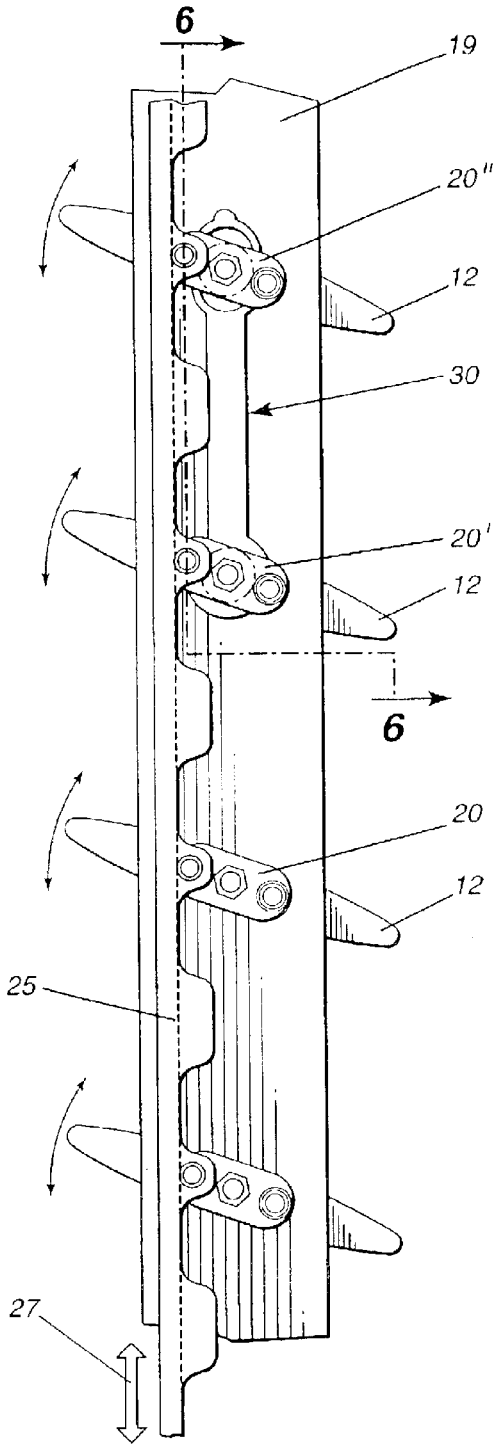
FIG. 4 is a plan view showing how the slat connectors are interconnected together by an interconnecting member and illustrating the position of a friction brake member secured about the cylindrical sleeve of adjacent connectors of adjacent slats.

As shown in FIG. 4 these connectors 20 are all interconnected together by a longitudinal slot interconnecting member or arm 25 which is better illustrated in FIG. 9. As shown in FIG. 9 there are two such arms 25 and each one is provided with shoulders 26 provided with pivot holes (not shown) but illustrated and described in my above-referenced U.S. Patent, which receives the pivot pins 24 and by translating the longitudinal slat interconnecting member 25 upwards or downwards in the direction of arrow 27, all of the slats are displaced in unison to any desired angular position. However, in order to retain the slats to the said desired position there is provided the friction brake member 30 of the present invention which is retained about the cylindrical sleeve 21 of two adjacent connectors 20', as shown in FIG. 4.

Figure 5:
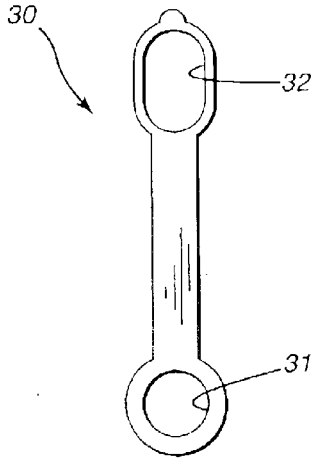
FIG. 5 is a plan view showing the configuration of the friction brake member.

With reference now to FIGS. 5–9 there will be described the construction of the friction brake member 30 of the present invention. As shown in FIG. 5 the friction brake member 30 is a plastic molded flat friction brake arm which is provided with at least two spaced-apart apertures and namely a first aperture 31 and a second aperture 32 which are disposed at opposed ends of the friction brake arm. The first aperture 31 is of circular cross section and is dimensioned to receive a cylindrical sleeve 21 of one of the connectors 20 as illustrated in FIGS. 9 and 6 in close rotational fit therein. Accordingly, there is no friction between the inner wall of the first aperture 31 and the outer wall of the cylindrical sleeve 21. The first aperture 31 is to attach the arm only and provides no braking force.

The second aperture 32 is however dimensioned for friction fit about the outer wall of the cylindrical sleeve 21 of an adjacent connector 20 whereby to arrest the adjacent connector 20", as shown in FIG. 4 when its associated slat is displaced to a desired position. Because all of the connectors 20 are interconnected by the slat interconnecting member 25 they will all move in unison by displacing any one of the slats and the friction retention of the connector 20" is sufficient to prevent all of the louvers from being freely rotated even with the downward load of the longitudinal slat interconnecting member 25 acting on the connectors. Although FIG. 4 only shows a single friction brake arm 30 interconnected to adjacent slat connectors there may be two or more of these friction brake arms secured spaced-apart within a stile. As shown in FIG. 6 the friction brake arm is disposed under the connector arms 23 of the adjacent connectors.

Figure 7:
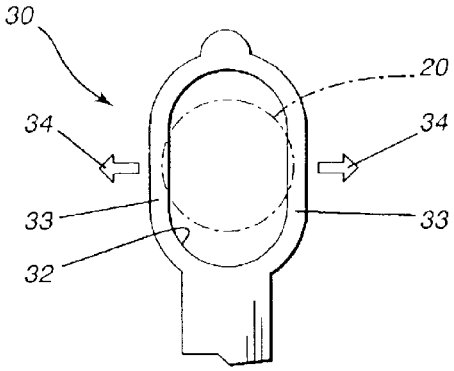
FIG. 7 is an enlarged view of the second friction aperture provided in the friction brake member.
Figure 8:
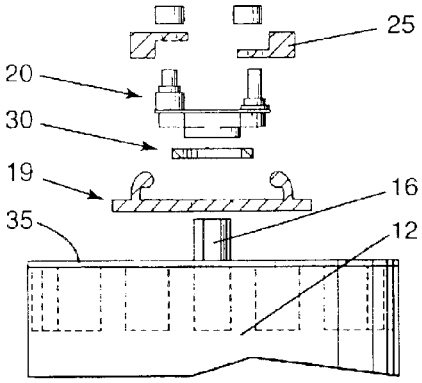
FIG. 8 is a side view showing the configuration of a pivot rod secured to the end wall of a slat.

As shown in FIG. 7 the second aperture 32 is a longitudinal aperture formed in the arm 30 and defines opposed narrow flexible side walls 33. The side walls 33 are spaced apart a predetermined distance which is less than the diameter of the cylindrical sleeve 20, as hereinshown in phantom lines, whereby the flexible side walls 33 will flex slightly outwards in the direction of arrows 34 when the aperture 22 is press fit about the cylindrical sleeve 21 of the connector 20 and their restoring force apply a clamping friction force against the sleeve 21. As shown in FIG. 8 the pivot rods 16 are provided with a retention collar 35 which is integrally formed about an outer peripheral end thereof for snap fit retention of the connectors thereabout.

As shown in FIG. 9 the friction brake arm 30' may be differently formed and as hereinshown it is provided with a third aperture 32' which is identical to the second aperture 32 and which operates in the same manner with an adjacent connector 20'" thereby providing additional frictional retention of the louvers at desired positions as above described. This third aperture is provided on the other side of the central aperture and both the second and third aperture are equidistantly spaced from the central aperture 31. It is also conceivable that the friction brake arm may be provided with more friction apertures if the louvered structure has a great many slats or if the slats are heavy. However, the friction brake arm as shown in FIG. 9 has been found to be most efficient for most common size louvered structures which are used on windows and doors. The bigger the louver the more friction brakes can be added. These louvered structures usually have the slats and stiles formed of plastic material with the pivot rods integrally molded with the slat end wall which has the shape of the removable connector 35 as shown in FIG. 6 wherein a plurality of projections 36 extend from the connector end wall 35 and may be glued or welded or simply snap fitted within the open end of the slats 12. The slats are fairly light weight.

It is within the ambit of the present invention to cover any obvious modifications of the preferred embodiments described herein providing such modifications fall within the scope of the appended claims.

What is claimed is:

1. A louvered structure having a plurality of slats pivotally interconnected between opposed stiles of a rectangular frame, each said slats having a pivot rod projecting from opposed end walls thereof and extending into axially aligned holes formed in an inner face of said opposed stiles, a connector secured to each said pivot rods in one of said stiles, said connector having a cylindrical sleeve secured about said rod and at least one connector arm extending laterally from said cylindrical sleeve, said connector arm of said connector of each said slats being interconnected to a longitudinal slot interconnecting member by a pivot connection secured to each said connector arms whereby all of said slats pivot in unison about said pivot rods, and a friction brake member having a first and a second spaced-apart aperture, said first aperture being dimensioned to receive said cylindrical sleeve of one of said connectors in close rotational fit therein; said second aperture being dimensioned for friction fit about a cylindrical sleeve of an adjacent connector to arrest said adjacent connector and its associated slat, and all other connectors and associated slats interconnected thereto by said longitudinal slat interconnecting member, at a desired slat angle by displacing any one of said slats to said desired angle.

2. A louvered structure as claimed in claim 1 wherein said pivot rod of each said slats to which one of said connectors is secured has a non-circular cross-section and wherein said connector is provided with a connecting bore of like non-circular cross-section whereby to rigidly connect thereto.

3. A louvered structure as claimed in claim 2 wherein said cylindrical sleeve and said connector arm are integrally formed and wherein said pivot connection is constituted by a pivot pin projecting upwardly from said arm on a side opposed from said cylindrical sleeve and is also integrally formed therewith.

4. A louvered structure as claimed in claim 3 wherein said connector has a pair of said connector arms extending diametrically from said cylindrical sleeve on opposed sides thereof, therebeing two of said longitudinal slat interconnecting members each pivotally interconnecting with respective ones of said pivot pins of each said arms.

5. A louvered structure as claimed in claim 1 wherein said friction brake member is a plastic molded flat friction brake arm disposed under said connector arms of said adjacent connectors.

6. A louvered structure as claimed in claim 5 wherein said second aperture is a longitudinal aperture formed in said flat friction brake arm and defining opposed narrow flexible side walls, said side walls being spaced-apart a predetermined distance less than the diameter of said cylindrical sleeve of said connectors whereby to flex outward for friction retention about said cylindrical sleeve.

7. A louvered structure as claimed in claim 6 wherein said friction brake arm is a straight arm and provided with a third aperture which is identically formed to said second aperture.

8. A louvered structure as claimed in claim 7 wherein said first aperture is located intermediate said second and third aperture.

9. A louvered structure as claimed in claim 5 wherein said pivot rods are each provided with a retention collar integrally formed about an outer peripheral end thereof for snap-fit retention with said connector.

10. A louvered structure as claimed in claim 1 wherein said slats and stiles are formed of plastic material, said pivot rods being integrally molded with a slat end wall removable connector.

* * * * *